US006710024B2

(12) United States Patent
Raether et al.

(10) Patent No.: US 6,710,024 B2
(45) Date of Patent: Mar. 23, 2004

(54) WASHING ACTIVE PREPARATION

(75) Inventors: Roman Benedikt Raether, Limburgerhof (DE); Sylke Haremza, Neckargemuend (DE); Susanne Brinkmann-Rengel, Ober-Olm (DE)

(73) Assignee: BASF Aktiengesellschaft, Ludwigshaften (DE)

( * ) Notice: Subject to any disclaimer, the term of this patent is extended or adjusted under 35 U.S.C. 154(b) by 0 days.

(21) Appl. No.: 10/311,218

(22) PCT Filed: Jun. 11, 2001

(86) PCT No.: PCT/EP01/06581

§ 371 (c)(1),
(2), (4) Date: Dec. 16, 2002

(87) PCT Pub. No.: WO01/96515

PCT Pub. Date: Dec. 20, 2001

(65) Prior Publication Data

US 2003/0109414 A1 Jun. 12, 2003

(30) Foreign Application Priority Data

Jun. 16, 2000 (DE) ..... 100 29 696

(51) Int. Cl.[7] ..... C11D 3/37; C11D 1/83; C11D 13/10

(52) U.S. Cl. ..... 510/475; 510/360; 510/361; 510/476; 510/477; 510/499

(58) Field of Search ..... 510/360, 361, 510/475, 476, 477, 499

(56) References Cited

U.S. PATENT DOCUMENTS

| | | | | |
|---|---|---|---|---|
| 4,661,279 A | | 4/1987 | Parker | 252/94 |
| 4,719,282 A | | 1/1988 | Nadolsky et al. | 528/310 |
| 5,207,941 A | | 5/1993 | Kroner et al. | 252/174.23 |
| 5,622,926 A | * | 4/1997 | Schade et al. | 510/340 |
| 5,846,924 A | * | 12/1998 | Detering et al. | 510/475 |

FOREIGN PATENT DOCUMENTS

| | | |
|---|---|---|
| DE | 22 32 353 | 1/1973 |
| DE | 28 14 287 | 10/1979 |
| WO | WO 98/21301 | 5/1998 |

OTHER PUBLICATIONS

Derwent Abstracts, AN 1998–280702, XP–002178847, JP 10–096166, Apr. 14, 1998.

* cited by examiner

*Primary Examiner*—Brian P. Mruk
(74) *Attorney, Agent, or Firm*—Oblon, Spivak, McClelland, Maier & Neustadt, P.C.

(57) ABSTRACT

Disclosed are a detersive composition comprising a water-soluble or water-dispersible block copolymer preparable by controlled free-radical polymerization, a process for preparing such a detersive composition and the use of water-soluble or water-dispersible block copolymers preparable by controlled free-radical polymerization for preparing detersive compositions.

11 Claims, No Drawings

WASHING ACTIVE PREPARATION

The present invention relates to detersive substances comprising water-soluble block copolymers. The present invention further relates to a process for preparing such detersive substances and to the use of specific block copolymers for preparing such detersive substances.

Detersive compositions are customarily used for cleaning soiled textiles, especially soiled clothing. A problem may arise here because textiles of any kind, but in particular textiles as used in the manufacture of clothing, are customarily made up of a multiplicity of different fabrics which, moreover, have been provided with different colors by a wide variety of dyeing processes.

There are in addition textiles which have not been subject to a particular dyeing process, but which, for example by bleaching, have been converted into a colorless, i.e. white, state and are used in that form.

The cleaning of textiles by means of detersive substances is intended to remove soil from the textiles without significantly affecting the original appearance of the textiles with regard to color and texture. While this task is relatively easy to accomplish for single-color textiles which, moreover, are ideally made of a single material, the cleaning of multicolored textiles or of a mixture of textiles having different colors presents problems. A particular problem in this context is presented by the cleaning of textiles or textile mixtures possessing light colors and dark colors, for example white and blue or white and black. Here the use of customary detersive substances will frequently cause a transfer of color from the dark textiles or textile constituents to the lighter ones, so that a textile article which was, say, white before laundering may have a darker color thereafter.

However, such transfers of color are unwelcome to the users of detersive substances, since the appearance of the textiles is generally adversely affected as a result.

A multiplicity of proposals have been made in the past to solve this problem.

For instance, DE-A-2 232 353 describes a washing and cleaning agent mixture possessing an improved inhibiting effect with regard to dye transfer. This reference proposes that color transfer may be inhibited by including a water-soluble polymer based on polyvinylpyrrolidone in a washing and cleaning agent mixture. For example, a copolymer of polyvinylpyrrolidone with acrylonitrile or maleic anhydride is said to be advantageous. However, the copolymers mentioned do not have a block structure.

DE-A-2 814 287 likewise describes a washing agent that contains discoloration-inhibiting additives. It proposes that discolorations occurring during washing may be prevented by including a water-soluble or -dispersible homo- or copolymer of N-vinylimidazole in a washing and cleaning agent. The polymers described, however, likewise have no block structure.

It is an object of the present invention to provide detersive compositions that substantially prevent dye transfer during the wash.

We have found that this object is achieved by a detersive composition as described hereinbelow.

A block copolymer for the purposes of the present invention is a polymer that has at least two blocks characterized by different monomer compositions. "Different monomer compositions" in the context of the present invention is to be understood as meaning that at least two regions of the block copolymer have different monomer compositions. It is possible in the context of the present invention that the transition between two blocks is continuous, i.e. that there exists a zone between two blocks which has a random or regular sequence of the monomers constituting the blocks. In the context of the present invention, however, it is similarly envisaged that the transition between two blocks be substantially discontinuous. By "a substantially discontinuous transition" is meant a transition zone which has a distinctly shorter length than at least one of the blocks separated by the transition zone. It is possible in this connection that a block may be based on one type of monomer only. However, it is similarly envisaged that a block may be composed of two or more monomers. In a preferred embodiment of the present invention, the chain length of such a transition zone is less than 1/10, preferably less than 1/20, of the block length of at least one of the blocks separated by the transition zone.

In the context of the present invention, "different monomer compositions" is further to be understood as meaning that the monomers constituting the respective block differ in at least one feature, for example in their linkage to one another, in their conformation or in their constitution. When, as already described above a block is based on more than one type of monomer, blocks of the block copolymer which are different in the present context may also differ, for example, in having different concentrations of the monomers constituting each block. In the context of the present invention, preference is given to the use of block copolymers which have at least two blocks whose monomer compositions differ at least in the constitution of the monomers.

The present invention accordingly provides a detersive composition comprising at least a) from 0.01 to 50% by weight of a water-soluble or water-dispersible block copolymer A which has a molecular weight of more than 1 000 and is preparable by a process comprising the following steps (i) and (ii):

(i) free-radically reacting a reaction mixture comprising at least one free-radically reactive monomer (a) in the presence of at least one free radical of the formula (III)

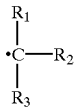

(III)

where $R_1$ to $R_3$ are each independently hydrogen, methyl or a group which stabilizes free radicals and/or is bulky and which is selected from the group consisting of substituted or unsubstituted, linear or branched-chain alkyl of two or more carbon atoms, substituted or unsubstituted cycloalkyl radicals, substituted or unsubstituted alcohol radicals, substituted or unsubstituted ether radicals, substituted or unsubstituted polyether radicals, substituted or unsubstituted amine radicals, substituted or unsubstituted aralkyl radicals, substituted or unsubstituted aromatic, heterocyclic or olefinic hydrocarbon, halogen atoms (Hal), substituted or unsubstituted, linear or branched-chain alkenyl or alkynyl groups, —C(O)$R_5$, —C(O)O$R_5$, —C$R_5R_6$—O—$R_7$, —O—C(O)$R_5$, —CN, —O—CN, —S—CN, —O—C=N$R_5$, —S—C=N$R_5$, —O—C$R_5R_6$—C$R_7R_8$N$R_9R_{10}$, —N=C=O, —C=N$R_5$, —C$R_5R_6$-Hal, —C(S)$R_5$, —C$R_5R_6$—P(O)$R_7R_8$, —C$R_5R_6$—P$R_7R_8$, —C$R_5R_6$—N$R_7R_8$, —C$R_5R_6$(O$R_7$)(O$R_8$), —C$R_5R_6$(O$R_7$)(N$R_8$), —C$R_5R_6$(N$R_7$)(N$R_8$), an acid anhydride, acetal or ketal group, —S$O_2R_5$, an amidine group —N$R_5$C(S)N$R_6$, —N$R_5$C(S)—O$R_6$,

—N=C=S, —NO2, —C=N—OH, —N($R_5$)=$NR_6$, —$PR_5R_6R_7$,

—$OSiR_5R_6R_7$, and —$SiR_5R_6R_7$, where $R_5$ to $R_{10}$ are each independently defined as $R_1$ to $R_4$ or two of $R_1$ to $R_4$ form a $C_4$- to $C_7$-ring, which in turn may be substituted or unsubstituted, and may optionally contain one or more heteroatoms, with the proviso that at least two of $R_1$ to $R_3$ are a group, as defined above, which stabilizes free radicals and/or is bulky, and (ii) free-radically reacting the product of step (i) in the presence of at least one free-radically homo- or copolymerizable monomer (b) and b) from 50 to 99.99% by weight of an anionic, cationic, zwitterionic or nonionic surfactant having a molecular weight of less than 1 000.

Preferably the free radical of the formula (III) is derived from at least one compound of the formula (I),

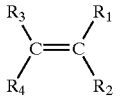

(I)

where $R_1$ to $R_4$ are each independently hydrogen, methyl or a group which stabilizes free radicals and/or is bulky and which is selected from the group consisting of substituted or unsubstituted, linear or branched-chain alkyl of two or more carbon atoms, substituted or unsubstituted cycloalkyl radicals, substituted or unsubstituted alcohol radicals, substituted or unsubstituted ether radicals, substituted or unsubstituted polyether radicals, substituted or unsubstituted amine radicals, substituted or unsubstituted aralkyl radicals, substituted or unsubstituted aromatic, heterocyclic or olefinic hydrocarbon, halogen atoms, substituted or unsubstituted, linear or branched-chain alkenyl or alkynyl groups, —C(O)$R_5$, —C(O)O$R_5$, —$CR_5R_6$—O—$R_7$, —O—C(O)$R_5$, —CN, —O—CN, —S—CN, —O—C=$NR_5$, —S—C=$NR_5$, —O—$CR_5R_6$—$CR_7R_8NR_9R_{10}$, —N=C=O, —C=$NR_5$, —$CR_5R_6$-Hal, —C(S)$R_5$, —$CR_5R_6$—P(O)$R_7R_8$, —$CR_5R_6$—$PR_7R_8$, —$CR_5R_6$—$NR_7R_8$, —$CR_5R_6$($OR_7$)($OR_8$), —$CR_5R_6$($OR_7$)($NR_8$), —$CR_5R_6$($NR_7$)($NR_8$), an acid anhydride, acetal or ketal group, —$SO_2R_5$, an amidine group —$NR_5$C(S)$NR_6$, —$NR_5$C(S)—$OR_6$, —N=C=S, —NO2, —C=N—OH, —N($R_5$)=$NR_6$, —$PR_5R_6R_7$, —$OSiR_5R_6R_7$, and —$SiR_5R_6R_7$, where $R_5$ to $R_{10}$ are each independently defined as $R_1$ to $R_4$ or two of $R_1$ to $R_4$ form a $C_4$- to $C_7$-ring, which in turn may be substituted or unsubstituted, and may optionally contain one or more heteroatoms, with the proviso that at least two of $R_1$ to $R_4$ are a group, as defined above, which stabilizes free radicals and/or is bulky, or diphenylethylene, dinaphthylethylene, 4,4'-vinylidenebis(N,N'-dimethylaniline), 4,4'-vinylidenebis(aminobenzene), cis- and trans-stilbene and/or from at least one compound of the formula (II)

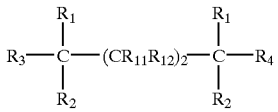

(II)

where $R_1$ to $R_4$ and $R_{11}$ and $R_{12}$ are each independently hydrogen, methyl or a group which stabilizes free radicals and/or is bulky and which is selected from the group consisting of substituted or unsubstituted, linear or branched-chain alkyl of two or more carbon atoms, substituted or unsubstituted cycloalkyl radicals, substituted or unsubstituted alcohol radicals, substituted or unsubstituted ether radicals, substituted or unsubstituted polyether radicals, substituted or unsubstituted amine radicals, substituted or unsubstituted aralkyl radicals, substituted or unsubstituted aromatic, heterocyclic or olefinic hydrocarbon, halogen atoms, substituted or unsubstituted, linear or branched-chain alkenyl or alkynyl groups, —C(O)$R_5$, —C(O)O$R_5$, —$CR_5R_6$—O—$R_7$, —O—C(O)$R_5$, —CN, —O—CN, —S—CN, —O—C=$NR_5$, —S—C=$NR_5$, —O—$CR_5R_6$—$CR_7R_8NR_9R_{10}$, —N=C=O, —C=$NR_5$, —$CR_5R_6$-Hal, —C(S)$R_5$, —$CR_5R_6$—P(O)$R_7R_8$, —$CR_5R_6$—$PR_7R_8$, —$CR_5R_6$—$NR_7R_8$, —$CR_5R_6$($OR_7$)($OR_8$), —$CR_5R_6$($OR_7$)($NR_8$), —$CR_5R_6$($NR_7$)($NR_8$), an acid anhydride, acetal or ketal group, —$SO_2R_5$, an amidine group —$NR_5$C(S)$NR_6$, —$NR_5$C(S)—$OR_6$, —N=C=S, —NO2, —C=N—OH, —N($R_5$)=$NR_6$, —$PR_5R_6R_7$, —$OSiR_5R_6R_7$, and —$SiR_5R_6R_7$, where $R_5$ to $R_{10}$ are each independently defined as $R_1$ to $R_4$ or two of $R_1$ to $R_4$ form a $C_4$- to $C_7$-ring, which in turn may be substituted or unsubstituted, and may optionally contain one or more heteroatoms, with the proviso that at least two of $R_1$ to $R_4$ are a group, as defined above, which stabilizes free radicals and/or is bulky.

In the context of the preparation of the copolymer used according to the invention, any free-radically reactive monomers may be used as monomer (a).

It will be appreciated that mixtures of different monomers may also be used as monomers (a) in the context of the present invention.

In addition, mixtures of at least one hydrophilic monomer and at least one hydrophobic monomer may be polymerized by the abovementioned process.

Specific examples of monomers (a) are:

dienes, such as butadiene, isoprene, myrcene or pentadiene, and furthermore $C_1$- to $C_{20}$-alkyl and hydroxyalkyl esters of monoethylenically unsaturated $C_3$- to $C_{10}$-monocarboxylic acids or $C_4$- to $C_8$-dicarboxylic acids, for example methyl methacrylate, ethyl methacrylate, propyl methacrylate (all isomers), butyl methacrylate (all isomers), 2-ethylhexyl methacrylate, isobornyl methacrylate, methyl acrylate, ethyl acrylate, propyl acrylate (all isomers), butyl acrylate (all isomers), 2-ethylhexyl acrylate, isobornyl acrylate, benzyl acrylate, phenyl acrylate, stearyl acrylate, diethyl maleate, hydroxyethyl acrylate, hydroxypropyl acrylate or hydroxybutyl acrylate, furthermore (meth)acrylates of alkoxylated $C_1$- to $C_{18}$-alcohols which have been reacted with from 2 to 50 mol of ethylene oxide, propylene oxide, butylene oxide or mixtures thereof; benzyl methacrylate, phenyl methacrylate, stearyl methacrylate, methacrylonitrile, acrylonitrile or functionalized methacrylates; acrylates and styrenes, selected from glycidyl methacrylate, 2-hydroxyethyl methacrylate, hydroxypropyl methacrylate (all isomers), hydroxybutyl methacrylate (all isomers), cyclohexyl methacrylate, cyclohexyl acrylate, hexyl methacrylate and hexyl acrylate (in each case all isomers), diethylaminoethyl methacrylate, triethylene glycol methacrylate, itaconic anhydride, itaconic acid, glycidyl acrylate, 2-hydroxyethyl methacrylate, diethylaminoethyl acrylate, triethylene glycol acrylate, methacrylamide, N-tert-butylmethacrylamide, N-n-butylmethacrylamide, N-methylolmethacrylamide, N-ethylolmethacrylamide, N-tert-butylacrylamide, N-butylacrylamide, N-methylol-acrylamide, N-ethylolacrylamide, vinylbenzoic acid (all isomers), diethylaminostyrene (all isomers), α-methylvinylbenzoic acid (all isomers), diethylamino-α-methylstyrene (all isomers), p-methylstyrene, p-vinylbenzenesulfonic acid, indene, trimethoxysilylpropyl methacrylate, triethoxysilylpropyl methacrylate, tributoxysilylpropyl methacrylate, diethoxymethylsilylpropyl methacrylate, dibutoxymethylsilylpropyl methacrylate, diisopropoxymethylsilylpropyl methacrylate, dimethoxysilylpropyl methacrylate, diethoxysilylpropyl methacrylate, dibutoxysilylpropyl methacrylate, diisopropoxysilylpropyl methacrylate, trimethoxysilylpropyl acrylate, triethoxysilypropyl acrylate, tributoxysilylpropyl acrylate, dimethoxymethylsilylpropyl acrylate, diethoxymethylsilylpropyl acrylate, dibutoxymethylsilylpropyl acrylate, diiso-propoxymethylsilylpropyl acrylate, dimethoxysilylpropyl acrylate, diethoxysilylpropyl acrylate, dibutoxysilylpropyl acrylate, diisopropoxysilylpropyl acrylate, vinyl acetate and vinyl butyrate, vinyl chloride, vinyl fluoride, vinyl bromide, vinyl alcohol, vinyl ethers of $C_1$- to $C_{18}$-alcohols, vinyl ethers of alkoxylated $C_1$- to $C_{18}$-alcohols and vinyl ethers of polyalkylene oxides, such as polyethylene oxide, polypropylene oxide or polybutylene oxide, monoethylenically unsaturated $C_3$- to $C_{10}$-monocarboxylic acids, their alkali metal salts and/or ammonium salts, for example acrylic acid or methacrylic acid, dimethylacrylic acid, ethylacrylic acid, allylacetic acid or vinylacetic acid, furthermore monoethylenically unsaturated $C_4$- to $C_8$-dicarboxylic acids, their monoesters, anhydrides, alkali metal salts and/or ammonium salts, for example maleic acid, fumaric acid, itaconic acid, mesaconic acid, methylenemalonic acid, citraconic acid, maleic anhydride, itaconic anhydride or methylmalonic anhydride; furthermore monoethylenically unsaturated monomers containing sulfonic acid groups or their salts, for example their alkali metal salts or ammonium salts, for example allylsulfonic acid, styrenesulfonic acid, 2-acrylamido-2-methylpropanesulfonic acid (AMPS), methallylsulfonic acid, vinylsulfonic acid, 3-sulfopropyl acrylate or 3-sulfopropyl methacrylate, furthermore monoethylenically unsaturated monomers containing phosphonic acid groups or their salts, for example their alkali metal salts or ammonium salts, for example vinylphosphonic acid, allylphosphonic acid or acrylamidoethylpropanephosphonic acid, furthermore amides and N-substituted amides of monoethylenically unsaturated $C_3$- to $C_{10}$-monocarboxylic acids or $C_4$- to $C_8$-dicarboxylic acids, for example acrylamide, N-alkylacrylamides or N,N-dialkylacrylamides, each having 1 to 18 carbon atoms in the alkyl group, such as N-methylacrylamide, N,N-dimethylacrylamide, N-tert-butylacrylamide or N-octadecylacrylamide, monomethylhexylmaleamide, monodecylmaleamide, diethyl-aminopropylmethacrylamide or acrylamidoglycolic acid; furthermore alkylamidoalkyl (meth)acrylates, for example dimethylamidoethyl acrylate, dimethylaminoethyl methacrylate, ethylaminoethyl acrylate, diethylaminoethyl methacrylate, dimethylaminopropyl acrylate or dimethylaminopropyl methacrylate; furthermore vinyl esters, such as vinyl formate, vinyl acetate or vinyl propionate, it also being possible for these to be present in hydrolyzed form after the polymerization; furthermore N-vinyl compounds, for example N-vinylpyrrolidone, N-vinylcaprolactam, N-vinylformamide, N-vinyl-N-methylformamide, 1-vinylimidazole or 1-vinyl-2-methylimidazole; furthermore vinyl ethers of $C_1$- to $C_{18}$-alcohols, vinyl ethers of alkoxylated $C_1$- to $C_{18}$-alcohols and vinyl ethers of polyalkylene oxides, such as polyethylene oxide, polypropylene oxide or polybutylene oxide, indene, dicyclopentadiene, monomers which carry amino or imino groups, such as dimethylaminoethyl methacrylate, diethylaminoethyl acrylate, diethylaminopropylmethacrylamide or allylamine, monomers which carry quaternary ammonium groups, for example present as salts as obtained by reacting the basic amino functions with acids, such as hydrochloric acid, sulfuric acid, nitric acid, formic acid or acetic acid, or in quaternized form (examples of suitable quaternizing agents are dimethyl sulfate, diethyl sulfate, methyl chloride, ethyl chloride or benzyl chloride), e.g. dimethylaminoethyl acrylate hydrochloride, diallyldimethylammonium chloride, dimethylaminoethyl acrylate methylchloride, dimethylaminoethylaminopropylmethacrylamide methosulfate, vinylpyridinium salts or 1-vinylimidazolium salts; monomers in which the amino groups and/or ammonium groups are liberated only after polymerization and subsequent hydrolysis, for example N-vinylformamide or N-vinylacetamide, and mixtures of two or more of the abovementioned monomers.

Preferably used as a first monomer (a) are styrenes, (meth)acrylates or their free acid, dienes or N-vinyl compounds, preferably those members of this group which have already been mentioned above, or mixtures of two or more thereof, if required with at least one further monomer (a) capable of free radical homopolymerization or copolymerization.

According to the invention, a compound of the formula (I)

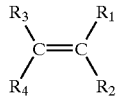

(I)

or of the formula (II)

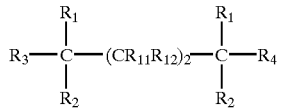

(II)

is further used in the preparation of the block copolymer A, in order to obtain the free radical of the formula (III).

In principle, it is also possible here to use all the compounds of the abovementioned formulae according to the invention, as long as they correspond to the definition given above and in the claims.

It is particularly important that at least two of the radicals $R_1$ to $R_4$ or $R_1$ to $R_3$ in formula (III) are each a radical-stabilizing and/or bulky group. The term "bulky group" as used in the context of the present invention means that this is a group whose size in each case in the novel reaction under free radical conditions is larger than or equal to the size of an isopropyl radical. The term "radical-stabilizing group" used according to the invention refers to groups of the type defined in claim 1, whose electron structure permits stabilization of radicals.

Specific examples are the following groups of the abovementioned type: branched-chain alkyl groups having three or more carbon atoms, in particular isopropyl and tert-butyl; cycloalkyl groups, for example unsubstituted or substituted cyclopentyl or cyclohexyl; alcohol groups, for example radicals of branched alcohols, such as isopropyloxy or tert-butyloxy; aralkyl radicals; substituted or unsubstituted aromatic or heterocyclic hydrocarbons, for example phenyl or pyridyl; halogen; cyano; nitro; ester groups having the structure —CO(O)$OR_5$, in which, for example, $R_5$ may be a linear or branched, unsubstituted or substituted alkyl, aralkyl or aromatic group.

Also preferably used are compounds of the formula (I) which have stabilizing groups of the following combinations as radicals:

at least one substituted or unsubstituted phenyl and C(O)$R_5$;

at least one substituted or unsubstituted phenyl and CN;

at least one substituted or unsubstituted phenyl and C(O)$OR_5$;

independently of one another, at least two substituted or unsubstituted phenyl groups;

independently of one another, at least two C(O)$OR_5$; and independently of one another, at least two CN.

In particular, the following are used as compound of the formula (I) or (II):

1,1,4,4-tetraphenyl-1,3-butadiene 1,4-bis(2-methylstyryl)benzene 1,2,3,4,5-pentaphenyl-1,3-cyclopentadiene 1,2,3,4-tetraphenyl-1,3-cyclopentadiene acenaphthylene cis- and trans-alpha-methylstilbene cis- and trans-4,4'-diphenylstilbene diphenylethylene, dinaphthylethylene, 4,4'-vinylidenebis(N,N'-dimethylaniline), 4,4'-vinylidenebis(aminobenzene), cis- and trans-stilbene, trans-, trans- and trans-, cis- and cis-cis-1,4-diphenyl-1,3-butadiene alpha-omega-tetraphenylpolyethyne diphenylfulvene triphenylethene tetraphenylethene 1-cyano-1-phenylethylene; 1-alkoxycarbonyl-1-phenylethylene; 1,1-dialkoxycarbonyl-2-ethylethylene; 1,1-dialkoxycarbonyl-2-phenylethylene, 1,1-dialkoxycarbonyl-2,2-dimethylethylene; 1,1-dialkoxycarbonylmethylethylene; 9-methylenexanthene; 9-methylenethioxanthene, 9-methylene-10-H-acridine and mixtures of two or more thereof.

According to the invention, the free radical formation can be effected by various methods. Thus, thermal, photochemical, electrochemical or electron transfer-induced production is just as possible as the use of oxidizing or reducing agents for producing free radicals.

In addition, the herein disclosed process can be carried out in the presence of at least one free radical initiator. Furthermore, thermally, electrochemically or photochemically initiating monomers can also be used as initiators. In general, however, all azo and/or peroxo compounds and/or compounds having homolytically cleavable C—C bonds which are conventionally used in free radical chain polymerization may be employed. Suitable initiators are described for example on page 10, line 17 to page 11, line 15 of WO 98/01478, which is hereby fully incorporated by reference in the context of the present application; moreover, 3,4-dimethyl-3,4-diphenylhexane and 2,3-dimethyl-2,3-diphenylbutane can be used. Preferably used initiators are those which are soluble in the reaction system used in each case. In the case of a reaction in the aqueous phase, oxidizing free radical initiators, e.g. potassium peroxodisulfate, sodium peroxodisulfate and ammonium peroxodisulfate, or a combination of a conventional, i.e. nonoxidizing, initiator with $H_2O_2$ are preferably used. Furthermore, dicumyl peroxide, dibenzoyl peroxide, dilauryl peroxide and AIBN may be used.

In a preferred embodiment of this process, a comparatively large amount of free radical initiator is added, the proportion of free radical initiator in the reaction mixture preferably being from 0.1 to 50, particularly preferably from 0.5 to 20, % by weight, based in each case on the total amount of the monomer (a) and of the initiator. Preferably, the molar ratio of initiator to compound (I) is from 3:1 to 1:3, particularly preferably from 2:1 to 1:2, in particular from 1.5:1 to 1:1.5.

When the described reaction according to step (i) is carried out in the aqueous phase, the term "aqueous phase" in the context of the present invention is understood as meaning a phase which contains from 10 to 100% by weight of water. If the water content of the aqueous phase is less than 10%, it is preferable in the context of the present invention if the aqueous phase contains a mixture of water and one or more water-miscible solvents, such as THF, methanol, ethanol, propanol, butanol, acetone, methyl ethyl ketone or the like. However, it is also possible to carry out the reaction according to step (i) in the presence of a mixture of water and a water-immiscible solvent, such as an aromatic solvent, for example toluene.

In a further embodiment, the above reaction according to step (i) is carried out in the presence of at least one base. It is possible in principle to use all low molecular weight bases, of which NaOH, KOH, ammonia, diethanolamine, triethanolamine, mono-, di- or triethylamine, dimethylethanolamine or a mixture of two or more thereof are preferred and ammonia and di- and triethanolamine are particularly preferred.

However, it is also possible to carry out the reaction according to step (i) in an organic solvent or in the absence of a solvent, for example in the melt. When the term "reaction procedure in an organic solvent or in the absence of a solvent" is used in the context of the present invention, it is understood as meaning a reaction procedure which takes place in the presence of less than 10, preferably less than 5 or less than 1% by weight of water. In a further embodiment of the present invention, at least one block copolymer is used in the novel binder composition, in the preparation of which block copolymer step (i) was carried out in an organic solvent or in the absence of a solvent, the water content of the reaction mixture being less than 0.5, for example less than 0.3 or less than 0.1% by weight. In a further embodiment of the present invention, the reaction procedure of step (i) is carried out in the absence of water, i.e. with a water content of less than 0.001% by weight. Such water contents can be achieved, for example, by using commercially available solvents as usually used as organic solvents in free radical polymerizations.

Suitable solvents in the context of the present invention are in principle all polar and nonpolar organic solvents in which the corresponding and preferably also the resulting polymers are soluble, possibly at elevated temperatures. Suitable solvents are, for example, $C_3$- to $C_{10}$-alkanes, cyclohexane, decalin, acetone, methyl ethyl ketone, diisobutyl ketone, tetrahydrofuran, dioxane, benzene, toluene, glycols, such as ethylene glycol or triethylene glycol, glycol ethers in which some or all of the terminal groups are blocked, such as ethylene glycol monomethyl ether, ethyl acetate, methanol or ethanol or the higher homologs of the alkanols of up to 18 carbon atoms (if necessary as cosolvent) or mixtures of two or more thereof.

The reaction according to step (i) is carried out in general at above room temperature and below the decomposition temperature of the monomers, the temperature range from 50 to 150° C. preferably being chosen, particularly preferably from 70 to 120° C., in particular from 80 to 110° C.

The reaction according to step (i) is carried out in general at from 1 to 300, for example from about 1.5 to 100 or from about 2 to about 20 bar.

Although there are no restrictions at all with respect to the molecular weight distribution, a reaction product which has a molecular weight distribution $M_w/M_n$, measured by gel permeation chromatography using polystyrene as standard, of $\leqq 4$, preferably $\leqq 3$, particularly preferably $\leqq 2$, in particular $\leqq 1.5$ and in specific cases even $\leqq 1.3$ can be obtained in the reaction according to (i). The molecular weights of the reaction product (A) can be controlled within wide limits by the choice of the ratio of monomers (a) to compounds (I) to free radical initiator. In particular, the content of compound (I) determines the molecular weight and does so in such a way that the greater the amount of compound (I), the lower the resulting molecular weight.

The reaction according to step (i) can also be carried out in the presence of a surfactant.

The reaction product obtained in the reaction according to (i) can be further processed directly or used as a macroinitiator for the further reaction according to step (ii), as defined further below herein. It is also possible to isolate the reaction product according to step (i) as a solid and then to subject it to further reaction.

In the reaction according to step (ii), at least one freely selectable monomer (b) capable of free radical homopolymerization or copolymerization can be reacted, suitable monomers (b) being the monomers stated above in the description of the monomers (a).

Monomer (b) may be identical to or different from the monomer (a) used in step (i). Of course, mixtures of two or more monomers may also be used as monomer (a) or monomer (b). The choice of the monomer (b) is made in principle according to the desired structure of the polymer prepared in step (ii) and hence according to the desired use of this polymer.

Specific examples are the following monomers (b) to be used with preference: N-vinylpyrrolidone, N-vinylimidazole, hydroxyethyl acrylate, hydroxyethyl methacrylate, acrylic acid, methacrylic acid, maleic anhydride, styrene or vinyl acetate.

The reaction according to step (ii) is carried out in principle under the conventional conditions for a free radical polymerization, it being possible for suitable solvents to be present. In addition, step (ii) is generally carried out under the same conditions as stated above for step (i). If desired, compounds according to formula I or II can be added again to carry out step (ii).

In the context of the novel process, steps (i) and (ii) can be carried out separately from one another in terms of both space and time, in which case of course step (i) is carried out first, followed by step (ii). In addition, however, steps (i) and (ii) can also be carried out in one reactor in succession, i.e. first the compound of the formula (I) is reacted with at least one monomer (a) completely or partly depending on the desired use or the desired properties, then at least one monomer (b) is added and is subjected to free radical polymerization, or a monomer mixture comprising at least one monomer (a) and at least one monomer (b) is used from the outset and is reacted with the compound (I). It is believed that the compound (I) first reacts with the at least one monomer (a) and the reaction product (A) formed therefrom then also reacts with the monomer (b) above a specific molecular weight. In this respect, it should be noted in particular that the novel (co)polymerization can be continued after any interruption without further initiator addition, by heating to a temperature at which the macroinitiator formed according to reaction product decomposes again after the first step (i).

The polymer resulting after the first step (i) may be isolated or reheated in situ to initiate the (further) polymerization in step (ii). Further monomer (b) may be added directly. Monomer (b) may be identical to or different from monomer (a). Moreover, monomer mixtures may be used from the outset. Step (ii) may be repeated as often as desired.

Depending on the reaction procedure, it is possible according to the invention to prepare terminally functionalized polymers, segmented polymers, block or multiblock and also gradient (co)polymers, star (co)polymers, graft copolymers and branched and hyperbranched (co)polymers.

As will be evident from the above, the present invention also relates to the use of the copolymers described in the context of the present invention, which are preparable by the above-defined process, for preparing detersive compositions.

In the context of the preparation of the copolymers, it is simple, by using a simply available compound (I) to provide block copolymers which have, for example, a hydrophilic block, such as a (meth)acrylic acid block, a methyl (meth) acrylate block, a hydroxyethyl (meth) acrylate block, or an N-vinylpyrrolidone block and a further, preferably hydrophobic polymer block, such as a block based on vinylaromatic monomers, e.g. styrene or substituted styrenes, and nonaromatic vinyl compounds, such as vinyl acetate, and higher ($>C_2$) alkyl (meth)acrylates.

In the context of the present invention, preference is given to using polymers of the following structure:

poly(acrylic acid-b-styrene), poly(methyl methacrylate-b-styrene), poly(styrene-b-vinyl acetate), poly(methacrylic acid-b-hydroxyethyl acrylate), poly(methyl methacrylate-b-N-vinylpyrrolidone), poly(methyl methacrylate-b-N-vinylformamide), poly(methyl methacrylate-b-hydroxyethyl acrylate).

The following block copolymers are also useful:

Poly(styrene-b-acrylic acid), poly(styrene-b-methyl acrylate), poly(styrene-b-methacrylic acid), poly(styrene-b-methyl methacrylate), poly(hydroxyethyl acrylate-b-methacrylic acid), poly(N-vinylpyrrolidone-b-methyl acrylate), poly(N-vinylpyrrolidone-b-ethyl acrylate), poly (N-vinylpyrrolidone-b-methyl methacrylate), poly(N-vinylpyrrolidone-b-ethyl methacrylate), poly(N-vinylpyrrolidone-b-styrene), poly(N-vinylpyrrolidone-b-vinyl acetate), poly(N-vinylpyrrolidone-b-α-methylstyrene), poly(N-vinylformamide-b-methyl methacrylate), poly(N-vinylformamide-b-ethyl methacrylate), poly(N-vinylformamide-b-vinyl acetate), poly(N-vinylformamide-b-methyl acrylate) or poly(N-vinylformamide-b-ethyl acrylate).

The following are also useful according to the present invention:

Poly(styrene-b-vinylpyrrolidone) and poly(styrene-stat-acrylonitrile-vinylpyrrolidone).

In the abovementioned block copolymers, the distribution of the blocks is to be chosen with regard to the length and monomers involved in block construction in such a way that the block copolymers obtained are water soluble or water dispersible.

The block copolymers A described herein may be used in pulverulent laundry detergents in amounts from 0.01 to 50% by weight. Their fraction of pulverulent laundry detergents is usually in the range from 0.05 to about 25% by weight or in the range from about 0.1 to about 15% by weight.

The detersive compositions of the invention include up to 49.99% by weight of additives in a preferred embodiment.

As well as the polymers mentioned, the laundry detergents of the invention additionally include anionic and/or nonionic surfactants and also builders to augment detergency and bind alkaline earth metal ions. Further useful ingredients are detergent alkalis, neutral salts, bleaches, antiredeposition agents, optical brighteners, enzymes and stabilizers and further auxiliary and addition agents customarily used in laundry detergents.

Useful anionic detergents include those of the sulfonate or sulfate type, for example alkylbenzenesulfonates, especially n-dodecylbenzenesulfonate, also olefinsulfonates, α-sulfo fatty acid esters, primary and secondary alkyl sulfates and also the sulfates of ethoxylated or propoxylated higher molecular weight alcohols.

Further compounds in this class, which may be optionally included in laundry detergents, are high molecular weight sulfated partial ethers and partial esters of polyhydric alcohols such as the alkali metal salts of the monoalkyl ethers or mono fatty acid esters of the glyceryl monosulfate ester or of 1,2-dioxypropanesulfonic acid. Also useful are sulfates of ethoxylated or propoxylated fatty acid amides and alkylphenols and also fatty acid taurides and fatty acid isethionates. Further useful anionic detergent bases include the alkali metal soaps of fatty acids of natural or synthetic origin, for example the sodium soaps of coco, palm kernel or tallow fatty acids.

Anionic detergent bases may be present in the form of the sodium, potassium and ammonium salts and also as salts of organic bases, such as mono-, di- or triethanolamine. When the anionic and zwitterionic compounds mentioned have an aliphatic hydrocarbon radical, it should preferably be straight chain and have from 8 to 22 carbon atoms. In compounds having an araliphatic hydrocarbon radical, the preferably unbranched alkyl chains contain on average from 6 to 15 carbon atoms.

Useful nonionic detergents include primarily polyglycol ether derivatives of alcohols, fatty acids and alkylphenols which contain from 3 to 30 glycol ether groups and from 8 to 20 carbon atoms in the hydrocarbon radical. Of particular utility are polyglycol ether derivatives in which the number of ethylene glycol ether groups is from 5 to 15 and whose hydrocarbon radicals are derived from straight-chain primary alcohols of from 12 to 18 carbon atoms or from alkylphenols having a straight alkyl chain of from 6 to 14 carbon atoms.

Further useful nonionic detergent bases are the water-soluble polyethylene oxide adducts formed by addition of from 20 to 250 ethylene glycol ether groups and from 10 to 100 propylene glycol ether groups to polypropylene glycol, ethylenediaminopolypropylene glycol and alkylpolypropylene glycol having from 1 to 10 carbon atoms in the alkyl chain. The compounds mentioned customarily contain from 1 to 5 ethylene glycol units per propylene glycol unit. Nonionic compounds of the type of the amine oxides and sulfoxides, which may also be ethoxylated, are also useful.

It is also possible to include zwitterionic detergents, such as alkylbetaines and alkylsulfobetaines, for example 3-(N,N-dimethyl-N-alkylammonium)-propane-1-sulfonate and 3-(N,N-dimethyl-N-alkylammonium)-2-hydroxypropane-1-sulfonate.

Useful builders include phosphates, such as pentasodium triphosphate and its mixtures with its hydrolysis products, i.e. sodium pyro- and orthophosphates, and the acidic and neutral potassium pyrophosphates which are particularly useful for preparing liquid laundry detergents.

Useful builders further include complexing aminopolycarboxylic acids. These include in particular alkali metal salts of nitrilotriacetic acid and ethylenediaminotetraacetic acid. Also useful are the salts of diethylenetriaminopentaacetic acid and the higher homologs of the aminopolycarboxylic acid mentioned. These homologs are preparable for example by polymerization of an ester, amide or nitrile of N-acetaziridine and subsequent hydrolysis to carboxylic acid salts or by reaction of polyethyleneimine with chloroacetate or bromoacetate salts in an alkaline medium. Useful aminopolycarboxylic acids further include poly-(N-succinic acid)-ethyleneimine, poly-(N-tricarballylic acid)-ethyleneimine and poly-(N-butane-2,3,4-tricarboxylic acid)-ethyleneimine, which are obtainable similarly to the N-acetic acid derivatives.

Useful ingredients further include complexing polyphosphonic acid salts, for example the alkali metal salts of aminopolyphosphonic acids, especially aminotri (methylenephosphonic acid), 1-hydroxyethane-1,1-diphosphonic acid, methylenediphosphonic acid, ethylenediphosphonic acid and also salts of the higher homologs of the polyphosphonic acids mentioned. Mixtures of the aforementioned complexing agents may also be used.

Of particular importance are nitrogen- and phosphorus-free polycarboxylic acids which form complex salts with calcium ions, and these polycarboxylic acids include carboxyl-containing polymers. Citric acid, tartaric acid, benzenehexacarboxylic acid and tetrahydrofurantetracarboxylic acid are suitable. Polycarboxylic acids containing carboxymethyl ether groups are also useful, such as 2,2'-oxydisuccinic acid and also polyhydric alcohols or hydroxycarboxylic acids which are partially or completely etherified with glycolic acid, for example triscarboxymethylglycerol, biscarboxymethylglyceric acid and carboxymethylated or oxidized polysaccharides. It is further possible to use polymeric carboxylic acids having a molecular weight of at least 350 in the form of the water-soluble sodium or potassium salts, such as polyacrylic acid, polymethacrylic acid, poly-α-hydroxyacrylic acid, polymaleic acid, polyitaconic acid, polymesaconic acid, polybutenetricarboxylic acid and also the copolymers of the corresponding monomeric carboxylic acids with each other or with ethylenically unsaturated compounds such as ethylene, propylene, isobutylene, vinyl methyl ether or furan.

Complexing agents which are insoluble in water may also be used. These include phosphorylated cellulose and graft polymers of acrylic acid or methacrylic acid on cellulose, which may be present as fabrics or fiber webs. It is further possible to use three-dimensionally crosslinked and hence water-insolubilized copolymers of acrylic, methacrylic, crotonic and maleic acid and also of other polymerizable polycarboxylic acids, optionally with further ethylenically unsaturated compounds in the form of the sodium or potassium salts as sequestrants. These insoluble copolymers may be present as webs, sponges or else in the form of finely ground low-density films having an open-celled structure.

Useful water-insoluble builders further include alkali metal aluminosilicates and alkali metal borosilicates, which may contain bound water and have a calcium-binding capacity of at least 50 mg of CaO/g of active substance. These include in particular compounds of the formula $(Na_2O)_x Al_2O_3(SiO_2)$, wherein x is from 0.7 to 1.5 and y is from 1.3 to 4. Mixtures of the aforementioned water-soluble and water-insoluble builders may also be used.

Useful detergent alkalis include the carbonates, bicarbonates, borates and silicates of sodium and of potassium, especially sodium carbonate and sodium silicates having an $Na_2O:SiO_2$ ratio of from 1:1 to 1:3.5.

Useful bleaches include oxygen-releasing bleaches, such as alkali metal perborates, percarbonates, perpyrophosphates and persilicates and also urea perhydrate. Preference is given to using sodium perborate in anhydrous form or tetrahydrate. The laundry detergents may include magnesium silicate to stabilize the percompounds, for example in amounts of from 3 to 20% by weight, based on the amount of perborate. Laundry detergents to be used at below 70° C., known as cold wash detergents, may include bleach activators of the class of the N- or O-acyl compounds which react with hydrogen peroxide in aqueous solution to form peracids. Preferred bleach activators are tetraacetylmethylenediamine, tetraacetylethylenediamine and tetraacetylglycoluril. The powder particles consisting of the bleach activator or of the percompound may be coated with sheathing substances, such as water-soluble polymers or fatty acids, in order that any interaction between the percompound and the activator may be avoided during storage.

Instead of bleaching percompounds and mixtures thereof with bleach activators, the laundry detergent of the invention may also be combined with active chlorine bleaches, for example sodium hypochlorite, lithium hypochlorite, sodium dichloroisocyanurate, potassium dichloroisocyanurate or trichloroisocyanuric acid or else mixtures of alkali metal persulfates and alkali metal chlorides which react in use to form hypochlorite. This combining may be effected during the production of the laundry detergents or else immediately before or during use. To avoid losses, the active chlorine compounds may likewise be sheathed or granulated with inorganic or organic sheathing substances.

The laundry detergents may further include optical brighteners, especially derivatives of diaminostilbenedisulfonic acid or alkali metal salts thereof. Useful examples include salts of 4,4'-bis(2"-anilino-4"-morpholino-1,3,5-triazinyl-6"-amino)-stilbene-2,2'-disulfonic acid or similarly constructed compounds which bear a diethanolamino group, a methylamino group or a β-methoxyethylamino group instead of the morpholino group. Also useful as brighteners for polyamide fibers are those of the type of the diarylpyrazolines, for example 1-(p-sulfonamidophenyl)-3-(p-chlorophenyl)-$\Delta^2$-pyrazoline and similarly constructed compounds which bear a carboxymethyl or acetylamino group instead of the sulfonamido group. It is further possible to use substituted aminocoumarins, for example 4-methyl-7-dimethylamino- or 4-methyl-7-diethylamino-coumarin. Useful polyamide brighteners further include the compounds 1-(2-benzimidazolyl)-2-(1-hydroxyethyl-2-benzimidazolyl)ethylene and 1-ethyl-3-phenyl-7-diethylaminocarbostyryl. Useful brighteners for polyester and polyamide fibers are the compounds 2,5-di-(2-benzoxazolyl)thiophene, 2-(2-benzoxazolyl)naphtho-[3,4-n]-thiophene and 1,2-di-(5-methyl-2-benzoxazolyl) ethylene. Brighteners of the substituted diphenylstyryl type may also be present. Mixtures of the aforementioned brighteners may also be used.

Useful antiredeposition agents include in particular carboxymethylcellulose, methylcellulose, water-soluble polyesters and polyamides of polybasic carboxylic acids and glycols or diamines having free carboxyl, betaine or sulfobetaine groups capable of salt formation and also colloidally water-soluble polymers or copolymers of vinyl alcohol, or vinylpyrrolidone, of acrylamide and of acrylonitrile.

The laundry detergents may further include enzymes of the class of the proteases, lipases and amylases or mixtures thereof. Of particular utility are enzymatic ingredients obtained from bacterial strains or fungi such as *Bacillus subtilis, Bacillus licheniformis* and *Streptomyces griseus.*

Useful ingredients further include neutral salts, especially sodium sulfate, and also biocides, such as halogenated diphenylmethanes, salicylanilides, carbanilides and phenols. Liquid laundry detergents may also include hydrotropic substances and solvents, such as alkali metal salts of benzene-, toluene- or xylene-sulfonic acid, urea, glycerol, polyglycerol, di- or triglycol, polyethylene glycol, ethanol, i-propanol and ether alcohols.

Known foam inhibitors, such as saturated fatty acids and alkali metal soaps thereof having from 20 to 24 carbon atoms, trialkylmelamines, hydrocarbons and silicones, may also be present, if appropriate.

The quantitative composition of the laundry detergent of the invention may vary within wide limits, preferably within the following limits (in percent by weight):

| | |
|---|---|
| 0.1–10% | preferably 0.2–5%, of polymer according to invention |
| 0.5–30% | preferably 1–20%, of soap and/or sulfate or sulfonate surfactant, |
| 0.5–30% | preferably 1–20%, of nonionic surfactant, |
| 0–60% | preferably 5–50%, of builders, |
| 0–25% | of detergent alkalis, |
| 0–30% | preferably 10–25%, of oxygen-releasing bleaches, especially sodium perborate and its combination with bleach activators and stabilizers, |
| 0–3% | preferably 0.5–2%, of antiredeposition agents, |
| 0–1% | of optical brighteners, dyes and scents and also antimicrobial substances, |
| 0–3% | preferably 0.2–2%, of foam inhibitors. |

The present invention also provides a process for preparing a detersive substance as claimed in any of claims 1 to 6, which comprises mixing at least a) from 0.01 to 50% by weight of a block copolymer A which has a molecular weight of more than 1 000 and is preparable by a process comprising the following steps (i) and (ii):

(i) free-radically reacting a reaction mixture comprising at least one free-radically reactive monomer (a) in the presence of at least one free radical of the formula (III)

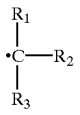

(III)

where $R_1$ to $R_3$ are each independently hydrogen, methyl or a group which stabilizes free radicals and/or is bulky and which is selected from the group consisting of substituted or unsubstituted, linear or branched-chain alkyl of two or more carbon atoms, substituted or unsubstituted cycloalkyl radicals, substituted or unsubstituted alcohol radicals, substituted or unsubstituted ether radicals, substituted or unsubstituted polyether radicals, substituted or unsubstituted amine radicals, substituted or unsubstituted aralkyl radicals, substituted or unsubstituted aromatic, heterocyclic or olefinic hydrocarbon, halogen atoms (Hal), substituted or unsubstituted, linear or branched-chain alkenyl or alkynyl groups, —C(O)$R_5$, —C(O)O$R_5$, —$CR_5R_6$—O—$R_7$, —O—C(O)$R_5$, —CN, —O—CN, —S—CN, —O—C═$NR_5$, —S—C═$NR_5$, —O—$CR_5R_6$—$CR_7R_8NR_9R_{10}$, —N═C═O, —C═$NR_5$, —$CR_5R_6$-Hal, —C(S)$R_5$, —$CR_5R_6$—P(O)$R_7R_8$, —$CR_5R_6$—$PR_7R_8$, —$CR_5R_6$—$NR_7R_8$, —$CR_5R_6(OR_7)(OR_8)$, —$CR_5R_6(OR_7)(NR_8)$, —$CR_5R_6(NR_7)(NR_8)$, an acid anhydride, acetal or ketal group, —$SO_2R_5$, an amidine group —$NR_5C(S)NR_6$, —$NR_5C(S)$—$OR_6$, —N═C═S, —NO2, —C═N—OH, —N($R_5$)═$NR_6$, —$PR_5R_6R_7$, —O$SiR_5R_6R_7$, and —$SiR_5R_6R_7$, where $R_5$ to $R_{10}$ are each independently defined as $R_1$ to R4 or two of $R_1$ to $R_4$ form a $C_4$- to $C_7$-ring, which in turn may be substituted or unsubstituted, and may optionally contain one or more heteroatoms, with the proviso that at least two of $R_1$ to $R_3$ are a group, as defined above, which stabilizes free radicals and/or is bulky, and (ii) free-radically reacting the product of step (i) in the presence of at least one free-radically homo- or copolymerizable monomer (b) and b) from 50 to 99.99% by weight of an anionic, cationic or nonionic surfactant having a molecular weight of less than 1 000.

The present invention further provides for the use of a block copoplymer A having a molecular weight of more than 1 000, which is preparable by means of an above-described process comprising steps (i) and (ii), for preparing detersive compositions.

EXAMPLES 100 g of N-vinylpyrrolidone, 0.8 g of 1,1-diphenylethene and 0.49 g of azodiisobutyronitrile are heated at 85° C. for 6 h. 5 g of styrene are then added and the mixture is heated at 110° C. for a further 6 h without stirring. A solid, water-soluble substance is obtained.

Application Tests

The influence of a polymer prepared according to the invention on the stability of liquid laundry detergents was tested using the following liquid laundry detergent composition:

| | |
|---|---|
| 30 parts | of addition product of 7 mol of ethylene oxide with 1 mol of $C_{13}/C_{15}$ oxo alcohol |
| 8 parts | of dodecylbenzenesulfonic acid |
| 15 parts | of coco fatty acid |
| 5 parts | of monoethanolamine |
| 3 parts | of polypropylene glycol of molar mass 600 |
| 7 parts | of 1,2-propylene glycol |
| 15 parts | of a modified polycarboxylate (reaction product of maleic anhydride-isobutene copolymer with 8-tuply ethoxylated $C_{12}/C_{14}$ oxo alcohol as per EP-A 0 367 049) |
| 1 part | of the polymer acting as dye transfer inhibitor |
| 16 parts | of water |

The prior art dye transfer inhibitor polymer used in the above-described liquid detergent formulation was polyvinylpyrrolidone of K 17.

The inventive dye transfer inhibitor used was poly(N-vinylpyrrolidone-b-styrene) prepared according to example 1.

The effectiveness of polymers prepared according to the invention with regard to dye transfer inhibition was determined by washing tests in which the dye was added to the liquor in dissolved form. The dye used was Basilen Brown E-4-R (C.I. Reactive Brown 32) and the laundry detergent used was Persil color liquid, which included in each case 1%, based on the laundry detergent quantity, of one of the polymers specified in table 2. The wash conditions and dye transfer inhibition are summarized.

TABLE 1

| | |
|---|---|
| Apparatus | Launder-o-meter |
| Cycles | 1 |
| Temperature | 60° C. |
| Duration | 30 min |
| Water hardness | 3 mmol $Ca^{2+}$, $Mg^{2+}$ (4:1)/l |
| Test fabrics | 10 g of cotton, |
| | 5 g of polyester/cotton, |
| | 5 g of polyester |
| Liquor ratio | 1:12.5 |
| Liquor amount | 250 ml |
| Concentration | 7 g/l |
| Dye concentration | 0.001% of Basilen Brown E-4-R |

TABLE 2

| | Dye transfer inhibition | | |
|---|---|---|---|
| | Reflectance | | |
| | Cotton | Polyester/cotton | Polyester |
| Persil color liquid | 58.5 | 59.0 | 80.7 |
| Persil color liquid + 1% of polymer of Ex. | 78.2 | 77.4 | 80.6 |
| Persil color liquid + 1% of Collidon | 77.8 | 77.2 | 80.4 |

As can be seen in table 2, the addition of 1% of a polymer to be used according to the invention is very effective in preventing dye transfer with regard on cotton and polyester/cotton. In addition, the polymer has a better dye transfer inhibiting effect than commonly known dye transfer inhibiting polymers at the same concentration.

We claim:

1. A detersive composition comprising at least a) from 0.01 to 50% by weight of a water-soluble or water-dispersible block copolymer A which has a molecular weight of more than 1 000 and at least two polymer blocks characterized by a different monomer composition, wherein the at least two polymer blocks consist of at least one hydrophilic and of at least one hydrophobic block, and is preparable by a process comprising the following steps (i) and (ii):

(i) free-radically reacting a reaction mixture comprising at least one free-radically reactive monomer (a) in the presence of at least one free radical of the formula (III)

(III)

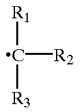

where $R_1$ to $R_3$ are each independently hydrogen, methyl or a group which stabilizes free radicals and/or is bulky and which is selected from the group consisting of substituted or unsubstituted, linear or branched-chain alkyl of two or more carbon atoms, substituted or unsubstituted cycloalkyl radicals, substituted or unsubstituted alcohol radicals, substituted or unsubstituted ether radicals, substituted or unsubstituted polyether radicals, substituted or unsubstituted amine radicals, substituted or unsubstituted aralkyl radicals, substituted or unsubstituted aromatic, heterocyclic or olefinic hydrocarbon, halogen atoms (Hal), substituted or unsubstituted, linear or branched-chain alkenyl or alkynyl groups, —C(O)$R_5$, —C(O)O$R_5$, —$CR_5R_6$—O—$R_7$, —O—C(O)$R_5$, —CN, —O—CN, —S—CN, —O—C═$NR_5$, —S—C═$NR_5$, —O—$CR_5R_6$—$CR_7R_8NR_9R_{10}$, —N═C═O, —C═$NR_5$, —$CR_5R_6$-Hal, —C(S)$R_5$, —$CR_5R_6$—P(O)$R_7R_8$, —$CR_5R_6$—$PR_7R_8$, —$CR_5R_6$—$NR_7R_8$, —$CR_5R_6(OR_7)(OR_8)$, —$CR_5R_6(OR_7)(NR_8)$, —$CR_5R_6(NR_7)(NR_8)$, an acid anhydride, acetal or ketal group, —$SO_2R_5$, an amidine group —$NR_5C(S)NR_6$, —$NR_5C(S)$—$OR_6$, —N═C═S, —NO2, —C═N—OH, —N($R_5$)═$NR_6$, —$PR_5R_6R_7$, —$OSiR_5R_6R_7$, and —$SiR_5R_6R_7$, where $R_5$ to $R_{10}$ are each independently defined as $R_1$ to $R_3$ or two of $R_1$ to $R_3$ form a $C_4$- to $C_7$-ring, which in turn may be substituted or unsubstituted, and may optionally contain one or more heteroatoms, with the proviso that at least two of $R_1$ to $R_3$ are a group, as defined above, --- which stabilizes free radicals and/or is bulky, whereby a product is obtained, which has a molecular weight distribution $M_w/M_n$, measured by gel permeation chromatography using polystyrene as standard, of ≦3, and (ii) free-radically reacting the product of step (i) in the presence of at least one free-radically homo- or copolymerizable monomer (b) and b) from 50 to 99.99% by weight of an anionic, cationic, zwitterionic or nonionic surfactant having a molecular weight of less than 1000.

2. A detersive composition as claimed in claim 1, including up to 49.99% by weight of additives.

3. A detersive composition as claimed in claim 2, wherein said additives include builders.

4. A detersive composition as claimed in claim 1, wherein said surfactants include anionic and nonionic surfactants.

5. A detersive composition as claimed in claim 1, wherein said block copolymer A has from 2 to 6 blocks.

6. A detersive composition as claimed in claim 5, wherein at least one block in said block copolymer A has a polyvinylpyrrolidone structure.

7. A detersive composition as claimed in claim 1, wherein the product of step (i) has a molecular weight distribution $M_w/M_n$ of ≦2.

8. A detersive composition as claimed in claim 1, wherein the product of step (i) has a molecular weight distribution of $M_w/M_n$ of ≦1.5.

9. A process for preparing a detersive composition which comprises mixing at least a) from 0.01 to 50% by weight of a water-soluble or water-dispersible block copolymer A which has a molecular weight of more than 1000 and at least two polymer blocks characterized by a different monomer composition, wherein the at least two polymer blocks consist of at least one hydrophilic and of at least one hydrophobic block, and is preparable by a process comprising the following steps (i) and (ii):

(i) free-radically reacting a reaction mixture comprising at least one free-radically reactive monomer (a) in the presence of at least one free radical of the formula

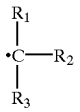

(III)

where $R_1$ to $R_3$ are each independently hydrogen, methyl or a group which stabilizes free radicals and/or is bulky and which is selected from the group consisting of substituted or unsubstituted, linear or branched-chain alkyl of two or more carbon atoms, substituted or unsubstituted cycloalkyl radicals, substituted or unsubstituted alcohol radicals, substituted or unsubstituted ether radicals, substituted or unsubstituted polyether radicals, substituted or unsubstituted amine radicals, substituted or unsubstituted aralkyl radicals, substituted or unsubstituted aromatic, heterocyclic or olefinic hydrocarbon, halogen atoms (Hal), substituted or unsubstituted, linear or branched-chain alkenyl or alkynyl groups, —C(O)$R_5$, —C(O)O$R_5$, —$CR_5R_6$—O—$R_7$, —O—C(O)$R_5$, —CN, —O—CN, —S—CN, —O—C═$NR_5$, —S—C═$NR_5$, —O—$CR_5R_6$—$CR_7R_8NR_9R_{10}$, —N═C═O, —C═$NR_5$, —$CR_5R_6$-Hal, —C(S)$R_5$, —$CR_5R_6$—P(O)$R_7R_8$, —$CR_5R_6$—$PR_7R_8$, —$CR_5R_6$—$NR_7R_8$, —$CR_5R_6(OR_7)(OR_8)$, —$CR_5R_6(OR_7)(NR_8)$, —$CR_5R_6(OR_7)(NR_8)$, an acid anhydride, acetal or ketal group, —$SO_2R_5$, an amidine group —$NR_5C(S)NR_6$, —$NR_5C(S)$—$OR_6$, —N═C═S, —NO2, —C═N—OH, —N($R_5$)═$NR_6$, —$PR_5R_6R_7$, —$OSiR_5R_6R_7$, and —$SiR_5R_6R_7$, where $R_5$ to $R_{10}$ are each independently defined as $R_1$ to $R_3$ or two of $R_1$ to $R_3$ form a $C_4$- to $C_7$-ring, which in turn may be substituted or unsubstituted, and may optionally contain one or more heteroatoms, with the proviso that at least two of $R_1$ to $R_3$ are a group, as defined above, which stabilizes free radicals and/or is bulky, whereby a product is obtained, which has a molecular weight distribution $M_w/M_n$, measured by gel permeation chromatography using polystyrene as standard, of≦3, and (ii) free-radically reacting the product of step (i) in the presence of at least one free-radically homo- or copolymerizable monomer (b) and b) from 50 to 99.99% by weight of an anionic, cationic, zwitterionic or nonionic surfactant having a molecular weight of less than 1000.

10. A process as claimed in claim 9, wherein the product of step (i) has a molecular weight distribution $M_w/M_n$ of ≦2.

11. A process as claimed in claim 9, wherein the product of step (i) has a molecular weight distribution of $M_w/M_n$ of ≦1.5.

* * * * *

UNITED STATES PATENT AND TRADEMARK OFFICE

CERTIFICATE OF CORRECTION

PATENT NO. : 6,710,024 B2
DATED : March 23, 2004
INVENTOR(S) : Raether et al.

It is certified that error appears in the above-identified patent and that said Letters Patent is hereby corrected as shown below:

Title page,
Item [73], should read:
-- [73], Assignee, BASF Aktiengesellschaft, Ludwigshafen (DE) --

Signed and Sealed this

Thirteenth Day of July, 2004

JON W. DUDAS
*Acting Director of the United States Patent and Trademark Office*